US005762535A

United States Patent [19]

Nishiyama et al.

[11] Patent Number: 5,762,535

[45] Date of Patent: Jun. 9, 1998

[54] GARMENT HAVING THE FUNCTION OF KEEPING AN UPWARD PROFILE FOR THE HIP AND BUTTOCK LINE

[75] Inventors: Naruo Nishiyama; Junko Kasai; Kei Oya, all of Kyoto-fu, Japan

[73] Assignee: Wacoal Corp., Kyoto, Japan

[21] Appl. No.: 801,951

[22] Filed: Feb. 18, 1997

[30] Foreign Application Priority Data

Mar. 4, 1996 [JP] Japan ..... 8-045953

[51] Int. Cl.[6] ..... A41C 1/00; A41C 1/12

[52] U.S. Cl. ..... 450/98; 450/94; 450/99; 450/93; 2/400; 2/406

[58] Field of Search ..... 450/97, 98, 99, 450/107, 115, 116, 117, 118, 123, 124, 122, 129, 130, 131, 132, 125, 126, 127, 128, 134, 136, 137, 138, 139, 140; 2/73, 79, 227, 67, 69, 406, 400

[56] References Cited

U.S. PATENT DOCUMENTS

| | | | |
|---|---|---|---|
| 2,980,114 | 4/1961 | Montoya | 450/99 |
| 3,131,698 | 5/1964 | Morano | 450/99 |
| 3,236,241 | 2/1966 | Alexander et al. | 450/131 |
| 3,298,373 | 1/1967 | Marchisella | 450/99 |
| 3,339,554 | 9/1967 | Nobbs | 450/99 |
| 3,512,532 | 5/1970 | Sutter | 450/98 |
| 3,515,142 | 6/1970 | Black | 450/109 |
| 3,515,143 | 6/1970 | Black | 450/109 |
| 5,611,722 | 3/1997 | Osborne | 450/132 |

FOREIGN PATENT DOCUMENTS

| | | |
|---|---|---|
| 48-19321 | 6/1973 | Japan . |

*Primary Examiner*—Jeanette E. Chapman

*Attorney, Agent, or Firm*—Merchant, Gould, Smith, Edell, Welter & Schmidt, P.A.

[57] ABSTRACT

This invention relates to a garment having a crotch part and the function of keeping an upward profile for the hip and buttock line comprising a main body covering at least a buttock region, and a band-shaped patch being stretchable in at least the longitudinal direction. The patch is attached to the portion from the vicinity of the back center of the lower part of a buttock obliquely upward to the side direction of the main body, wherein the part covering at least a buttock part of the main body comprises a stretchable fabric containing an elastic fiber and the stretchable patch comprises a stretchable fabric which substantially does not contain an elastic fiber. The garment of the present invention has the function of keeping an upward profile for the hip and buttock line, is comfortable to wear without making a wearer feel restricted, is excellent in following the movement of the human body and thereby free from losing its shape, and is easy to put on as the patch is not twisted easily nor get out of the desired position. The garment of the present invention is suitable as a short panty, girdle, body suit, swim suit, leotard, tights, or the like.

17 Claims, 12 Drawing Sheets

GARMENT HAVING THE FUNCTION OF KEEPING AN UPWARD PROFILE FOR THE HIP AND BUTTOCK LINE

BACKGROUND OF THE INVENTION

1. Field of the Invention

The present invention relates to a garment having a crotch part and the functioning to keep an upward profile for the hip and buttock line.

2. Description of the Prior Art

Conventionally, a garment having a crotch part, such as short panty, girdle, body suit, swim suit, leotard, tights or the like has been known. In such garments, a garment main body covering at least the vicinity of a buttock of a back body is made of stretchable fabric containing an elastic fiber such as polyurethane fiber. Moreover, in the above mentioned garments, in order to strengthen the function of keeping an upward profile for the hip and buttock line, a band-shaped stretchable patch containing an elastic fiber such as polyurethane fiber is lined to the fabric of the main body. This patch is located in the portion from the vicinity of the back central part of the lower buttock, extending obliquely upward in the side direction. Consequently, the garment lifts the lower and side part of a buttock upwards, by utilizing the power of return by retraction of the patch. Such garments have been popular as female garments because they have the function of shaping female body lines beautifully.

FIG. 13 and FIG. 14 show the typical example of a conventional girdle having the function of keeping an upward profile for the hip and buttock line. FIG. 13 is a rear view and FIG. 14 is a front view of a conventional girdle.

The girdles shown in FIG. 13 and FIG. 14 comprise a fabric of the abdomen part 131, a fabric of the front side 132, a fabric of the back part covering a buttock 133, a crotch piece 134, and a fabric of the hem edge of front part 135. Numeral 136 is an opening for a leg, and 137 is a seam line of the back center. In order to keep superfluous flesh from swelling outward, a fabric of the abdomen part 131 is generally made of fabric which does not stretch or hardly stretches at least in the lateral direction of a girdle. Or a patch which does not stretch or hardly stretches at least in the lateral direction of a girdle is often attached to the front or reverse side of a fabric of the abdomen part 131. In general, fabrics of the other main parts, for example, a fabric of the front side 132 and a fabric of the back 133, are made of strechable fabric containing an elastic fiber such as polyurethane fiber which stretches at least in the lateral direction or as the case may be in both the lateral and longitudinal directions. Moreover, in this type of girdle, a fabric of the front side 132 and back side 133 may be made of separate fabrics and then seamed together. In general, however, fabrics of the front side 132 and back side 133 are made of one continuous fabric.

In such a girdle, in order to strengthen the function of keeping an upward profile for the hip and buttock line, a band-shaped patch 138 made of stretchable fabric containing an elastic fiber such as polyurethane fiber and which stretches in at least the longitudinal direction is lined to a fabric of the back side 133. The patch 138 extends from the vicinity of the back center of the lower buttock obliquely upward to the side direction in a manner in which the patch is attached to the outer edge of a buttock. Consequently, the power of return by retraction using the above mentioned elastic fiber of the garment main body and a patch strengthens the function of keeping an upward profile for the hip and buttock line by lifting a buttock from the lower and side part. Moreover, in general, a band-shaped patch 138 made of stretchable fabric containing an elastic fiber such as polyurethane fiber and being stretchable in at least the longitudinal direction is attached by seaming with a fabric of the back part 133, which is the fabric main body located at the most outer side. In this way the entire circumference of the patch is shown by a seam line 139. The case where the above mentioned band-shaped patch is attached by seaming with only the both sides without seaming its upper edge or lower edge is also suggested.

However, in the above mentioned conventional garment having a crotch part and strengthening the function of keeping an upward profile for the hip and buttock line, both the garment main body covering a buttock part and the band-shaped patch are made of stretchable fabric containing an elastic fiber such as polyurethane fiber. Consequently, the relatively strong stretching power of the dual stretchable fabric easily acts on a wearer's body in a portion to which the patch is attached. Therefore, a wearer feels quite uncomfortable when moving or doing exercise. And yet, a portion to which the patch is attached has a relatively strong power by the compressing power by retraction. Thus when a wearer moves so much or does exercise, that is, the movement of a wearer's skin is larger than the stretching of the fabrics, the garment slides up over the wearer's skin to thus lose its shape easily. There is also an indication that a wearer feels uncomfortable to wear due to the tightening of a garment.

In the case where the patch is attached to a fabric of the back side 133 by seaming with only the both sides of the patch without seaming the upper edge or lower edge of the patch, in addition to the above mentioned problems, the patch twists or slides up from the desired portion when the garment is worn.

The object of the present invention is to avoid the above mentioned problems and to provide a garment that keeps an upward profile for the hip and buttock line, is comfortable to wear without making wearers feel restricted, is excellent in following the movements of the human body, does not easily lose its shape, and is easy to put on because the patch is free from twisting or sliding up from the desired postion.

According to the following further preferred embodiments of the present invention, the garment can be provided, that keeps an upward profile for the hip and buttock line, has little distortion due to the difference of the stretchability between the patch and garment main body, and maintains an excellent appearance while preventing wrinkles when the garment is worn.

SUMMARY OF THE INVENTION

The present invention provides the following garment having the function of keeping an upward profile for the hip and buttock line.

(1) A garment has a crotch part and functions to keep an upward profile for the hip and buttock line. The garment a main body covering at least a buttock region, and a band-shaped patch being stretchable in at least the longitudinal direction. The patch is attached to the portion from the vicinity of the back center of the lower portion of the buttock obliquely upward to the side direction of the main body. The part of a fabric covering at least a buttock region of the garment is made of a stretchable fabric containing an elastic fiber and the stretchable patch is made of a stretchable fabric which substantially does not contain an elastic fiber.

In the garment of the present invention, the part of the main body covering at least a buttock is made of a stretchable fabric containing an elastic fiber and the stretchable patch is made of the stretchable fabric which substantially does not contain an elastic fiber. Consequently, the patch can supplement and support the function of keeping an upward profile for the hip and buttock line by the fabric of the main body containing an elastic fiber. However, the patch substantially does not contain an elastic fiber, so that the power of retraction is not too strong. Therefore, the present invention can provide a garment which is excellent in following the movement of the human body, does not easily lose its shape because of the moderate power of stretch, is comfortable to wear without making a wearer feel restricted, and is easy to wear because it easily can be stretched when put on.

(2) It is preferable in the garment having the function of keeping an upward profile for the hip and buttock line that both sides and an upper edge of the patch are seamed with the main body covering at least a buttock region. The lower edge of the patch is not seamed with the main body, or is seamed only with the folded portion where a hem edge of a fabric of the main body is folded back. In this embodiment of the garment, the lower edge of the patch becomes considerably free. When compared with the case where the entire circumference of the patch is seamed to be fixed to the main body, the garment having the function of keeping an upward profile for the hip and buttock line of the present invention can maintain an excellent appearance when worn by inhibiting wrinkles due to the difference in the stretchability between the patch and main body of the garment. Moreover, also in this embodiment, the patch is seamed with the main body in at least the upper and both side edges of the patch. Thus a garment having the function of keeping an upward profile for the hip and buttock line can be provided, that is easy to wear because the patch is not easily twisted or moved out of the desired position when worn, unlike the above mentioned case where only the both sides are seamed to the main body without seaming the upper and lower edges of the patch to the main body.

(3) It is preferable in the garment having the function of keeping an upward profile for the hip and buttock line that the patch stretchable in at least the longitudinal direction has a marginal stretchability in the longitudinal direction in the range of 120–250%. According to the above mentioned preferred embodiment, the present invention provides a garment that can be put on and taken off easily because the garment can easily be stretched, and the present invention also can provide the garment that is comfortable to wear without making a wearer feel resistance or tightness because the moderate power of the stretch is exhibited when worn, is excellent in following the movement of the human body, and does not easily lose its shape.

(4) It is preferable in the garment having the function of keeping an upward profile for the hip and buttock line that the patch stretchable in at least the longitudinal direction has the marginal stretchability in the longitudinal direction of in the range of 150–220%. According to the above mentioned preferred embodiment, the present invention provides the garment which can more easily be put on and taken off because the garment can easily be stretched. The present invention also can provide a garment which is comfortable to wear without making a wearer feel resistance or tightness because the moderate power of the stretch is exhibited when worn, is excellent in following the movement of human body, and does not easily lose shape.

(5) It is preferable in the garment having the function of keeping an upward profile for the hip and buttock line that the patch stretchable in at least the longitudinal direction has a width of 2–13 cm. According to the above mentioned preferred embodiment of the present invention, the discomfort in wearing due to the large width of the patch can be inhibited and the necessary function of keeping an upward profile for the hip and the buttock line can be demonstrated efficiently.

(6) It is preferable in the garment having the function of keeping an upward profile for the hip and buttock line that the patch stretchable in at least the longitudinal direction is a knitted fabric that does not substantially contain an elastic fiber. Such fabric is selected from the group consisting of tricot, tulle net, double tricot and smooth (kind of circular knitting fabric). These fabrics have the excellent touch and can be fitted to the human body. Consequently, even if a patch made of these fabrics is attached inside the garment, that is, the reverse side of the garment, the garment does not make the wearer feel uncomfortable. Moreover, these fabrics are available easily and excellent in durability, so that they can provide the garment having the function of keeping an upward profile for the hip and buttock line and excellent durability, with low cost.

(7) It is preferable in the garment having the function of keeping an upward profile for the hip and buttock line that the fabric of the main body covering a buttock region contains an elastic fiber and is stretchable in at least the lateral direction of the garment. According to the above mentioned embodiment, the present invention provides a garment that can easily be put on and taken off because the garment can be stretched in the lateral direction when being put on and taken off and can be fitted to the human body when worn.

(8) It is preferable in the garment having the function of keeping an upward profile for the hip and buttock line that the fabric which contains an elastic fiber and is stretchable in at least the lateral direction is selected from the group consisting of rochelle knitted fabric containing an elastic fiber, tricot knitted fabric containing an elastic fiber, and stretch lace containing an elastic fiber. According to the above mentioned preferred embodiment of the garment of the present invention, these fabrics provide appropriate stretchable fabrics. These fabrics have the excellent touch and can be fitted to the human body. Moreover, these fabrics are available easily and excellent in durability, so that they can provide a garment having the function of keeping an upward profile for the hip and buttock line, and excellent durability, with low cost.

(9) It is preferable in the garment having the function of keeping an upward profile for the hip and buttock line that the garment having a crotch part is a garment selected from the group consisting of short panty, girdle, body suit, swim suit, leotard and tights. These garments are worn by fitting to the human body or worn in direct contact with the human body or worn near to the human body. Consequently, the above mentioned function of keeping an upward profile for the hip and buttock line can be effectively demonstrated. Moreover, since these garments are worn in direct contact with or near to the human body, in other words, these garments are worn in the location to which the stretching power easily acts on the human body, it is required that the garment is comfortable to wear without making a wearer feel restricted. These above mentioned garments can effectively perform the above mentioned function.

(10) It is preferable in the garment having the function of keeping an upward profile for the hip and buttock line that the garment having a crotch part is a long-type girdle whose band-shaped stretchable patch having the stretchability is a two-plied fabric where a fabric of patch is folded into two. The patch is located in a position in which the folded portion is downward on the garment. The both sides and upper edge of the patch are seamed with the main body, but the lower edge of the patch is not seamed with the main body. According to the above mentioned preferable embodiment of the present invention, the patch becomes freeer because the lower edge thereof is not seamed. When compared to the case where the entire circumference of the patch is fixed by seaming with the main body, the above mentioned structure for attaching the patch to the main body can preferably inhibit the increase in distortion due to the difference in the stretchability between the patch and main body and can maintain an excellent appearance by preventing wrinkles on the garment when worn.

BRIEF DESCRIPTION OF THE DRAWINGS

FIG. 1(*b*) is a plan view illustrating each part of the stretchable patch in the girdle of FIG. 1(*a*).

DESCRIPTION OF THE PREFERRED EMBODIMENTS

Figure 1:
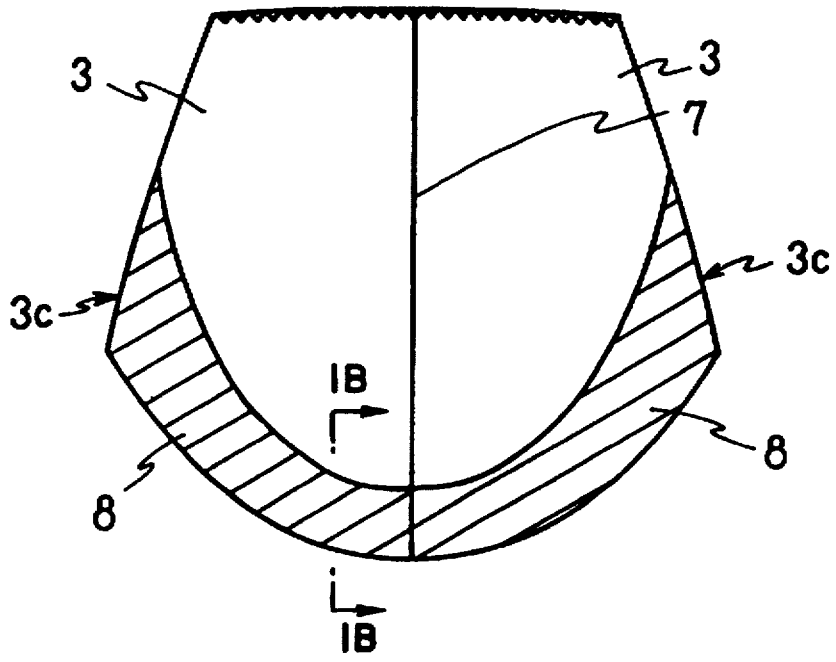
FIG. 1(*a*) is a rear view of a girdle of one embodiment of the present invention.
Figure 1:
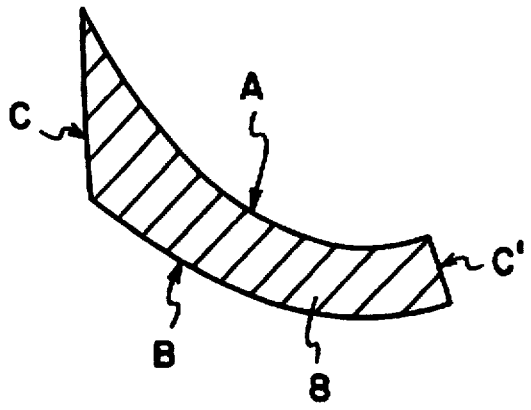

The present invention can provide a garment having a crotch part and the function of keeping an upward profile for the hip and buttock line. Such garments may be a short panty, girdle, body suit, swimming suit, leotard, tights or the like. This invention is not limited to the above mentioned illustrative examples of garments. However, the above mentioned garments are preferable. These garments are in direct contact with a body or worn near to a body, and these garments are designed to fit relatively tightly. Consequently, the compressing power by the patch efficiently operates on a wearer's body and the function of keeping an upward profile for the hip and buttock line is exhibited to shape the hip and buttock line beautifully. Moreover, these garments are worn in direct contact with the human body or worn nearer to the human body, in other words, these garments are worn in the location where the stretching power acts on the wearer's skin. Therefore, it is required that the garment be comfortable to wear without making a wearer feel restricted. As stated above, these garments of the present invention do not have a too strong power of retraction, are excellent in following the movements of the human body, have the moderate power of stretching without losing shape, and are comfortable to wear without making a wearer feel resistance or restricted. Consequently, these garments are suitable for effectively performing the above mentioned functions.

The fabrics that have been used conventionally for each part of these garments can also be used for the fabrics of each part of the garment of the present invention except a patch.

The fabrics used for these garments will be described as follows. In general, for a fabric of the abdomen part, which requires the function of abdomen-compression, a fabric which does not stretch or hardly stretches in at least the lateral direction of the garment is used. Or in the case where a fabric which stretches in at least the lateral direction is used as a fabric for the abdomen part, a fabric which does not stretch or hardly stretches in at least the lateral direction of the garment is used as a lined fabric for the abdomen part. On the other hand, in the case where the function of abdomen-compression is not required, it is preferable that a fabric which stretches at least in the lateral direction is used. In addition, for the part of a cup of a breast or a crotch piece, various kinds of fabrics suitable for the respective parts are used. For fabrics forming the other main parts of the body, fabrics containing an elastic fiber such as polyurethane fiber and being stretchable at least in the lateral direction are preferably used. According to this structure of the garment, a wearer can easily put on and take off the garment because the garment can be stretched laterally when being put on and taken off. Furthermore, the garment is preferably fitted to the human body when worn.

The examples of the above mentioned fabrics which are stretchable in the lateral direction of the garment include: (1) a polyurethane fiber-containing spandex power net as one of the rochelle knitted fabrics which contain an elastic fiber such as polyurethane fiber (2), a polyurethane fiber-containing two directions stretchable tricot knitted fabrics as one of the tricot knitted fabrics containing an elastic fiber such as polyurethane fiber, or (3) plain stitch fabric of paralleled yarn comprising an elastic fiber such as polyurethane fiber and non-elastic fiber, stretch lace containing an elastic fiber such as polyurethane fiber or the like. But these fabrics differ depending on the types of garments and the parts which the fabrics are used, so the materials for the garment are not limited to the above mentioned fabrics. Herein, the types of the spandex power net include plain power net, satin-like power net, two directions strechable rochelle, triconet and "TRISKIN" (product by Urabe Corporation) or the like.

Moreover, according to the present invention, in order to provide the function of keeping an upward profile for the hip and buttock line, it is necessary to use the fabric having the stretchability and containing an elastic fiber such as polyurethane fiber as the fabric for the main body covering at least the buttock region. For this purpose, the fabric which stretches in at least the lateral direction is preferably used. More preferably, in order to shape the bulge of a buttock more beautifully, a fabric having two directions stretchability that stretches in both the lateral and longitudinal directions is used.

The above mentioned band-shaped patch of the present invention substantially does not contain an elastic fiber and is stretchable in at least the longitudinal direction. Therefore, a patch made of a knitted fabric or woven fabric is used. This provides the stretchability of the fabric by means of the texture of the knitted fabric or the texture of the woven fabric. A stretchable knitted fabric and woven fabric containing an elastic fiber make considerable use of the stretchability of an elastic fiber material itself. Consequently, if a strechable knitted fabric or woven fabric containing an elastic fiber are used for both fabric of main body and a patch, the power of stretching becomes quite strong. However, since the patch having the stretchability in the longitudinal direction of the present invention substantially does not contain an elastic fiber and provides the stretchability of fabric by means of the texture of the knitted fabric or the texture of the woven fabric, the patch can stretch relatively easily over its full length. "Full length" herein denotes the length of a patch that which is stretched to the maximum length and cannot be stretched any further. Such knitted fabric or woven fabric whose stretchability is provided by the texture of the knitted fabric or the texture of the woven fabric is characterized in that when the texture of knitted fabric or texture of woven fabric stretch to their full limit length, they stop stretching. The limited stretchability where the fabrics cannot stretch any more is called "the marginal stretchability." Thus, the patch of the present invention can easily stretch with little resistance up to the marginal stretchability point and stop stretching at the moment of the marginal stretchability. In other words, the patch of the present invention uses the state of the stretchability before the marginal stretchability. "The stretchability in at least the longitudinal direction" herein signifies that if a fabric has the stretchability in at least the longitudinal direction, it may or may not have a stretchability in the other direction. Moreover, "substantially does not contain an elastic fiber" means that an elastic fiber is not contained in an amount sufficient for the stretchability of an elastic fiber to be exhibited by the fabric. In general, a stretchable fabric containing no elastic fiber at all can be used as the fabric of the patch. But a fabric containing an elastic fiber may be used as follows. If the content of an elastic fiber is small and the stretchability is nearly the same level as that of a fabric containing no elastic fiber, or the same stretching behavior is shown with the fabric containing no elastic fiber, the fabric having an elastic fiber can be used.

The fabric materials for the patch of the present invention having the marginal stretchability are made of knitted fabrics or woven fabrics that are stretchable in at least one direction. The preferable knitted fabric includes tricot, tulle net, double tricot, smooth (kind of circular knitting fabric), all of which substantially do not contain an elastic fiber. The knitted fabrics are made of the various fiber that do not have a great elasticity in the fiber itself. The examples of such various fibers include: polyester fiber, polyamide fiber, polypropylene fiber, acrylic fiber, polyvinylidene chloride fiber, vinylon fiber, other natural fiber such as cotton or the like. However, the fabric for the patch of the present invention is not limited to the above.

In the case where these strechable fabrics are used as a band-shaped patch, the patch is used in a way in which the stretchability in at least the longitudinal direction can be exhibited. The meaning of "band-shaped" or "longitudinal direction" in the patch is apparent from the following specific examples of the garments. A patch which is attached to a garment is not always a straight linear shape, and most of them curve along the outer edge of a buttock. Therefore, even if a patch is attached in a way in which it has the stretchability in at least the longitudinal direction in a certain portion, the patch does not have the stretchability in the longitudinal direction in the other part where the shape of the patch is changed to curve. In other words, the relative direction of stretch may change in a certain portion. The cases stated above are also included in "patch having band-shape and having the stretchability in at least the longitudinal direction." In particular, it is preferable that the patch which is located at the lower part of a buttock is attached in a way in which the patch is stretchable in the longitudinal direction. However, the location to which the patch is attached differs depending on the shapes or types of the garments, so that the concrete embodiment of the patch is not limited to the above.

The patch of the present invention is attached to the portion from the vicinity of the back center of the lower part of a buttock and extends obliquely upward in the side direction of the main body covering at least a buttock region. Moreover, the patch is generally provided on the reverse side of the main body of the garment, however, the patch may be provided on the front side of the main body of the garment.

It is preferable that the marginal stretchability in the longitudinal direction of the patch of the present invention be 120–250%. More preferably, the marginal stretchability falls in the range of 150–250%.

If the marginal stretchability is too small, the garment becomes difficult to put on and take off. Also, the garment becomes uncomfortable to wear. On the other hand, if the marginal stretchability is too large, the function of supplementing and supporting the function of keeping an upward profile for the hip and buttock line is deteriorated, or the function for preventing a garment from losing its shape tends to be also deteriorated.

"The marginal stretchability is in the range of 120–250%" means that the length of the patch when stretched to its full length (length B) is equal to 120–250% of the original length (length A) of the patch, wherein the original length of the stretched patch denotes the length of the patch which is not subjected to the stress. The length of the patch (B) denotes the length of the patch when the patch is stretched by applying the stress until the point of marginal stretchability is reached. The marginal stretchability will be expressed by the following mathematical formula. Marginal stretchability $(\%)=(B/A)\times 100$.

Whether a certain fabric is the fabric having the marginal stretchability or not can easily be recognized. If the fabric has the marginal stretchability, the fabric can be stretched to some extent but it cannot be stretched any more from the certain point.

The measurement of the marginal stretchability will be conducted as follows. The test piece of fabric is made by sewing in a ring-shaped a fabric having a width of 5 cm and a circumference of 20 cm (the sewing method: sewn by double needle overlook sewing machine: the sewing width of 5 mm, the number of the needles used for sewing: 20). The ring-shaped test piece of fabric is folded at the line X-Y, wherein X is an optional point on the circumference of the ring-shaped test piece and Y is the point on the circumference of the ring-shaped test piece located on the opposite side of X with respect to the diameter. This makes a two-folded test piece having the length of 10 cm, which is the half of the original length. The test piece of fabric is attached to the stick for pulling the test piece (inserting two sticks into the ring-shaped test piece at the place of X and Y, and pulling two sticks in the opposite directions respectively) by the use of an Instron type Constant-Rate Extension tensile tester ("AUTGRAPH" AG-500D, the product of Shimadzu Corporation). The tester is operated at the pulling rate of 30±2 cm/min and the load is applied until the test piece stretches to its full length and the marginal stretchability is measured.

The width of the patch of the present invention cannot be determined as a whole, because the types, sizes, shapes of the patch in the longitudinal direction changes. However, the preferable width of the patch is 2–13 cm, and more preferably the width is 2–7 cm. If the width of the patch falls within the above mentioned range, there is preferably provided a garment that is comfortable to wear, has the function of supporting and the function of keeping hip and buttock line, and has the function of preventing the garment from losing its shape. The width of the patch when the patch curves can be considered the width in the vertical direction with respect to the tangent line of the lower edge of the patch. The width of the patch may differ depending on the longitudinal direction. However, it is preferable that the width falls within the above mentioned range. In particular, the width in the vicinity of the back center or sides may be large.

With reference to the figures, examples of a garment according to the present invention are described below, but the invention is not limited to the illustrated examples alone.

Figure 2:
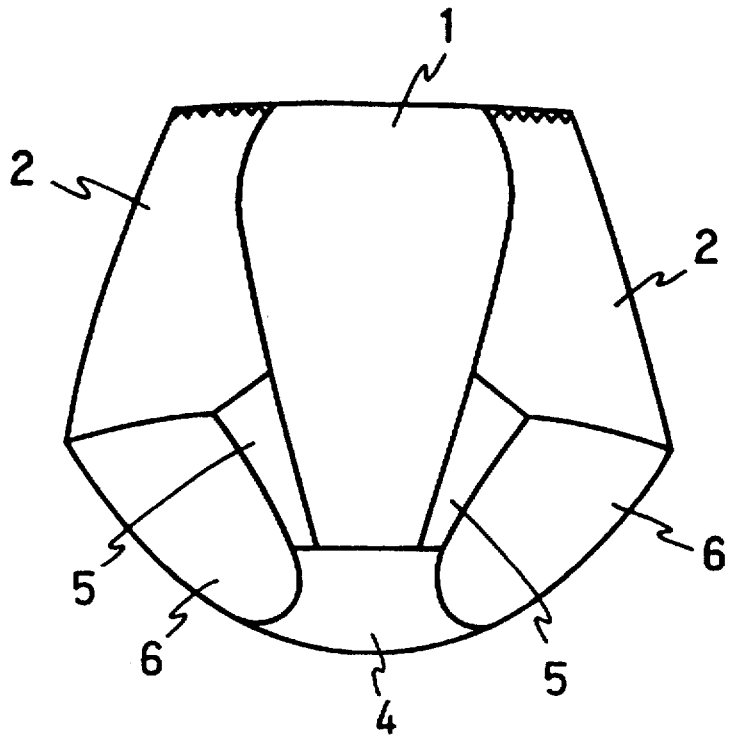
FIG. 2 is a front view of the girdle of FIG. 1(*a*).

FIG 1(*a*) is a rear view of the girdle of one embodiment of the present invention. FIG. 1(*b*) is a plan view illustrating the parts of the stretchable patch (which is attached on the left viewed from the back of the girdle) of the strechable fabric of FIG. 1(*a*). FIG. 2 is a front view of a girdle of FIG. 1(*a*).

The girdles shown in FIG. 1(*a*) and FIG. 2 comprise a fabric of the abdomen part 1, a fabric of the front side 2, a fabric of the back part covering a buttock 3, the crotch piece 4, and the fabric of the hem edge of the front part 5. Numeral 6 is an opening for a leg and, 7 is a seam line of back center. In order to keep superfluous flesh from swelling outward, the fabric of the abdomen part 1 is generally made of fabric that does not stretch or hardly stretches in at least the lateral direction of the girdle. Or a patch which does not stretch or hardly stretches in at least the lateral direction of the girdle is often attached to the front or reverse side of a fabric of the abdomen part 1. In general, fabrics of the other main parts, for example, a fabric of the front side 2 and a fabric of the back 3, are made of strechable fabric containing an elastic fiber such as polyurethane fiber, which stretches in at least the lateral direction or sometimes in both the lateral and longitudinal directions. Moreover, in this type of girdle, a fabric of the front side 2 and back 3 may be made of separate fabrics and then seamed them together. In general, however, the fabrics of the front side 2 and back 3 are made of one continuous fabric. In the patch 8 of FIG. 1(*b*), A is the upper edge, B is the lower edge, and C and C' are the both sides of the patch of the present invention.

In the girdle of the present invention, the band-shaped patch 8 which is stretchable in at least the longitudinal direction and which contains no elastic fiber such as polyurethane fiber, is attached to the reverse side of the fabric of the back part 3 in the portion from the vicinity of the back center of the lower buttock extending obliquely upward in the side direction.

As is apparent from FIG. 1(*a*), the patch is not always a straight linear band-shape but curves along the outer edge of the bulge of a buttock. In FIG. 1(*a*), the width of the patch is larger in the side portion than in the vicinity of the back center. In this girdle, the patch 8 is made of a stretchable fabric which substantially does not contain an elastic fiber, so that the girdle can easily be put on because it easily stretches when put on. Also the patch 8 supplements and supports the function of keeping an upward profile for the hip and buttock line of the fabric of the back part 3 containing an elastic fiber. Also the present invention can provide a girdle that is excellent in following the movements of the human body because of the moderate stretching power of the patch that, does not easily lose shape, and is comfortable to wear without making a wearer feel restricted. (When the girdle is shown in a front view like FIG. 2, the patch 8 can be partly seen in the portion of an opening for leg 6. However, if the patch 8 is illustrated in the figure, the figure is complicated and difficult to understand, so the patch 8 is omitted for only the front view. The same is true in the examples hereinafter.) The patch 8 may be attached to the fabric of the back part of the main body of the garment in a manner which the entire circumference is seamed. However, it is preferable that the structure for attaching the patch described below be employed.

Figures 3, 4, 5:
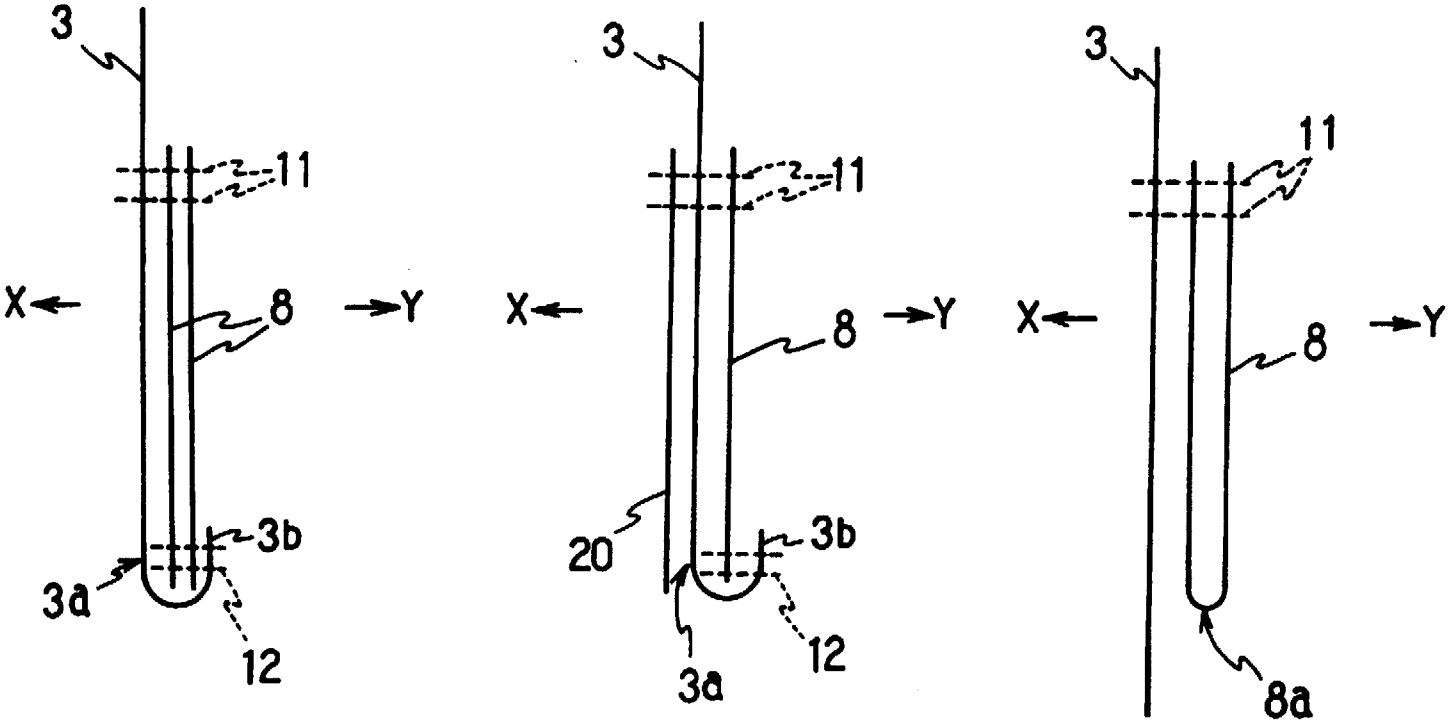
FIG. 3 is a schematic cross sectional view illustrating the structure of attaching the patch to the main body of the garment in one embodiment of the present invention.
FIG. 4 is a schematic cross sectional view illustrating the structure of attaching the patch to the main body of the garment in an alternative embodiment of the present invention.
FIG. 5 is a schematic cross sectional view illustrating the structure of attaching the patch to the main body of the garment in a further alternative embodiment of the present invention.

FIG. 3 is the schematic cross sectional view of FIG. 1(*a*) taken on line A–A', illustrating one embodiment of the structure of attaching the patch to the fabric of the back part 3 which is the main body of the garment. In FIG. 3, the direction of the arrow X is the outer side of the garment and the direction of the arrow Y is the inner side of the garment (side of the wearer's body). In this structure, the patch 8 is two-plied fabric (if necessary, one-ply fabric can be used) and the upper edge of the patch is seamed with the fabric of the back part 3 of the main body of the garment by a seam line 11. The lower edge of the patch is seamed with only the folded portion **3*b* where the fabric of the back part 3 of the main body is folded back inward as shown by seam line 12, whilst the lower edge of the patch is not seamed with the lower portion 3*a* of the fabric of the back part 3**. Moreover, although it is not shown, in FIG. 1(*a*), the part of the side in the longitudinal direction of the patch 8 is seamed with the girdle main body in the portion of a seam line 7 of the back center and the side part **3*c* respectively. In this structure of the girdle, the lower edge of the patch is considerably free. As compared with the case where an entire circumference of the patch including 3*a*** is fixed by seaming with the main body of the garment, this structure can provide the garment having the function of keeping an upward profile for the hip and buttock line that can maintain an excellent appearance when worn by inhibiting wrinkles due to the difference of stretchability between the patch and garment main body. The garment is easy to wear, prevents the patch from being twisted or sliding up from the predetermined place, is excellent in following the movement of the human body, inhibit the loss of shape, and is comfortable to wear without making a wearer feel restricted.

FIG. 4 is the schematic cross sectional view which is similar to FIG. 3, which illustrates an alternative embodiment of the structure for attaching the patch to the main body of the garment. The difference between FIG. 3 and FIG. 4 is that the band-shaped patch 8 used of the present invention of FIG. 4 is one-ply fabric (if necessary, the patch 8 may be made of two-ply fabrics or more) and that a stretch lace 20 or the like which contains an elastic fiber such as a polyurethane fiber and which has the same shape as the patch 8 is attached to the outer side of the main body of the garment in the direction of the arrow X at the back part 3. Also in this structure of the garment, the upper edge of the patch is seamed with the fabric of the back part 3 of the main body by the seam line 11. The lower edge of the patch is seamed with only the inside of the folded portion 3*b* where the fabric of the back part 3 is folded as shown by the seam line 12, whilst the lower edge of the patch is not seamed with the lower portion 3*a* of the fabric of the back part 3. Moreover, although it is not shown, the both sides in the longitudinal direction of the patch 8 are seamed with the fabric of the main body of the girdle as in the above mentioned embodiment. In this structure of the girdle, the lower edge of the patch becomes quite free. When compared with the case where an entire circumference of the patch including 3*a* is fixed by seaming together with the main body of the garment, this structure provides the garment having the function of keeping an upward profile for the hip and buttock line, which can maintain an excellent appearance in use by inhibiting wrinkles due to the difference in the stretchability between the patch and the main body of the garment. The garment is easy to wear, prevents the patch from being twisted or sliding up from the predetermined place, is excellent in following the movement of the human body, inhibits the loss of shape, and is comfortable to wear without making a wearer feel restricted.

FIG. 5 is the schematic cross sectional view which is the same as FIGS. 3 and 4, which illustrates an alternative embodiment of the structure of attaching the patch to the main body of the garment. The difference between FIG. 3 and FIG. 5 is that in FIG. 5, the band-shaped patch 8 is folded at its lower portion 8*a* to form a two-plied structure and that the lower edge (lower portion 8*a*) is not seamed with the main body of the garment. This type is preferably employed for the garment having a long hem, for example, long type girdle and tights shown in FIG. 9 and 10, because the fabric of the back part 3 of the main body of the garment is shown longer than that in FIG. 3. But it is not particularly limited to the above. In the case of the long type girdle or the like, the location to which the patch 8 is attached differs from those shown in FIGS. 1 and 2. In other words, the location is not in the vicinity of a hem of the girdle. In this type of the girdle, when worn, a distortion tends to be generated due to the difference of the stretchability between the patch and main body of the girdle. However, since the lower edge of the patch (lower portion 8*a*) is not seamed with the fabric of the back part 3, the lower portion of the patch becomes considerably free. As compared with the case where the entire circumference of the patch is fixed by seaming with the main body of the garment, this structure of the present invention can provide the garment having the function of keeping an upward profile for the hip and buttock line that can maintain an excellent appearance in use by inhibiting wrinkles generated due to the difference in the stretchability between the patch and main body of the garment. The garment is easy to wear, prevents the patch from being twisted or sliding up from the desired position, is excellent in following the movement of the human body, inhibits a loss of shape, and is comfortable to wear without making a wearer feel restricted. Moreover, this type of the structure of attaching the patch to the main body of the garment is not limited to the long type girdle. Needless to say, the structure of attaching the patch in the present invention as shown in FIG. 3 to FIG. 5 can be employed to every garment to which the present invention can be applied.

Figure 6:
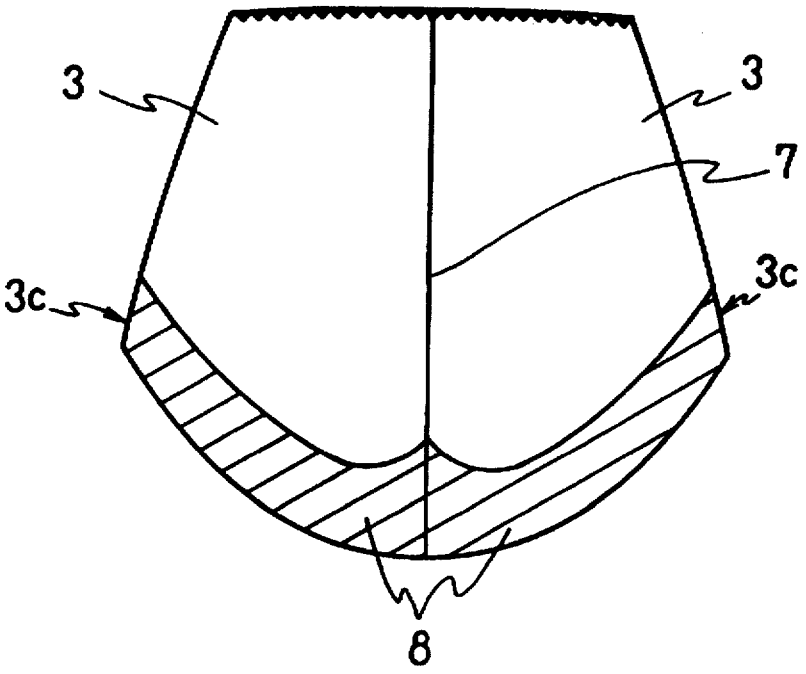
FIG. 6 is a rear view of a girdle of an alternative embodiment of the present invention.

FIG. 6 is a rear view of a girdle of an alternative embodiment of the present invention. A front view of the girdle is omitted because it is the same as FIG. 2. The main difference between FIG. 6 and FIGS. 1 and 2 is only the shape of the band-shaped stretchable patch 8 containing no elastic fiber. The shape of the patch shown in FIG. 1 is U-shaped as a whole. On the other hand, the shape of the patch shown in FIG. 6 is W-shaped as a whole. In this type of the girdle, same as in FIG. 1 and 2, the patch stretches easily when being put on. Also the patch supplements and supports the function of keeping an upward profile for the hip and buttock lines of the fabric of the back part 3 containing the polyurethane fiber, provides a girdle being excellent in following the movements of the human body because of the patch's moderate power of stretch, does not easily lose its shape, and is comfortable to wear without making a wearer feel restricted. Moreover, the patch is free from being twisted or getting out of the desired position when the garment is put on. In addition, the structure of attaching the patch to the fabric of a garment main body shown in any of FIGS. 3 to 5, can provide the girdle having the function of keeping an upward profile for the hip and buttock line which can maintain the excellent appearance without wrinkles on the main body of the garment due to the increased distortion between the patch and garment main body when worn.

Figure 7:
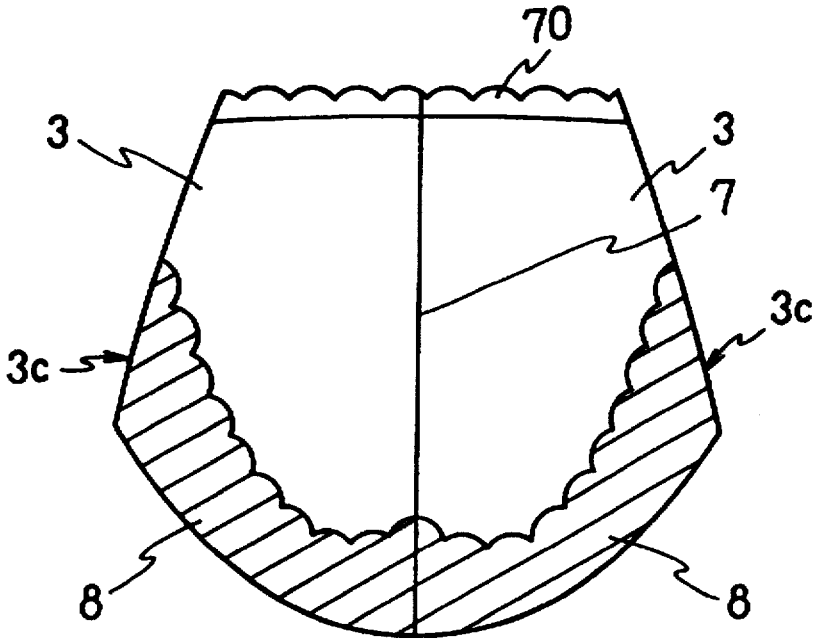
FIG. 7 is a rear view of a girdle of a further alternative embodiment of the present invention.

FIG. 7 is a rear view of a girdle of a further alternative embodiment of the present invention. A front view of the girdle is omitted because it is essentially the same as FIGS. 1 and 2. The girdle shown in FIG. 7 is the same as that shown in FIGS. 1–2 except that the band-shaped patch has the different shape and that a stretch lace 70 containing polyurethane fiber is attached to the waist line of the girdle. The shape of the patch shown in FIG. 1 is U-shaped as a whole. On the other hand, the shape of the patch shown in FIG. 7 is W-shaped as a whole and the upper edge of the patch has an ornamental pattern design. In this type of the girdle, as in FIGS. 1 and 2, the patch stretches easily when being put on. Also the patch supplements and supports the function of keeping an upward profile for the hip and buttock lines of the fabric of the back part 3 containing the polyurethane fiber, provides a girdle being excellent in following the movements of the human body because of the patch's moderate power of stretch, does not easily lose shape, and is comfortable to wear without making a wearer feel restricted. Moreover, the patch is free from being twisted or getting out of the desired position when the garment is put on. In addition, the structure of attaching the patch to the fabric of a main body of the garment shown in any of FIGS. 3–5, can provide the girdle having the function of keeping an upward profile for the hip and buttock line which can maintain the excellent appearance without wrinkles on the main body of the garment due to the increased distortion between the patch and garment main body when worn.

Figure 8:
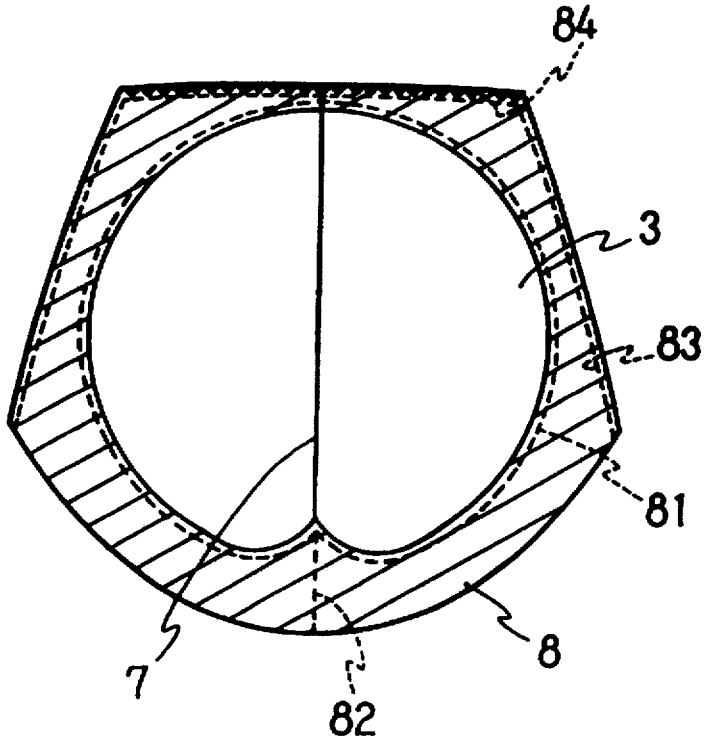
FIG. 8 is a rear view of a girdle of a further alternative embodiment of the present invention.

FIG. 8 is a rear view of a girdle of an alternative embodiment of the present invention. A front view of the girdle is omitted because it is the same as FIG. 2. The main difference between FIG. 8 and FIGS. 1 and 2 is only the shape of the band-shaped patch 8. The shape of the patch shown in FIG. 1 is U-shaped as a whole. On the other hand, in FIG. 8, the patch extends to the upper edge (near the waist line) of the girdle and the shape of the patch is O-shaped as a whole. In this type of the girdle, as in FIGS. 1 and 2, the patch stretches easily when being put on. Also the patch supplements and supports the function of keeping an upward profile for the hip and buttock lines of the fabric of the back part 3 containing the polyurethane fiber, provides a girdle that is excellent in following the movements of the human body because of the patch's moderate power of stretch, does not easily lose shape, and is comfortable to wear without making a wearer feel restricted. Moreover, the patch is free from being twisted or getting out of the desired position when put on. In addition, the structure of attaching the patch to the fabric of the main body of the garment by seaming in the seam lines 81, 83, 84, and 82 can provide the girdle having the function of keeping an upward profile for the hip and buttock line which maintains the excellent appearance when worn without wrinkles on the main body of the garment due to the distortion between the patch and main body of the garment, and is easily put on without the patch being twisted or moving out of the desired position.

Figure 9:
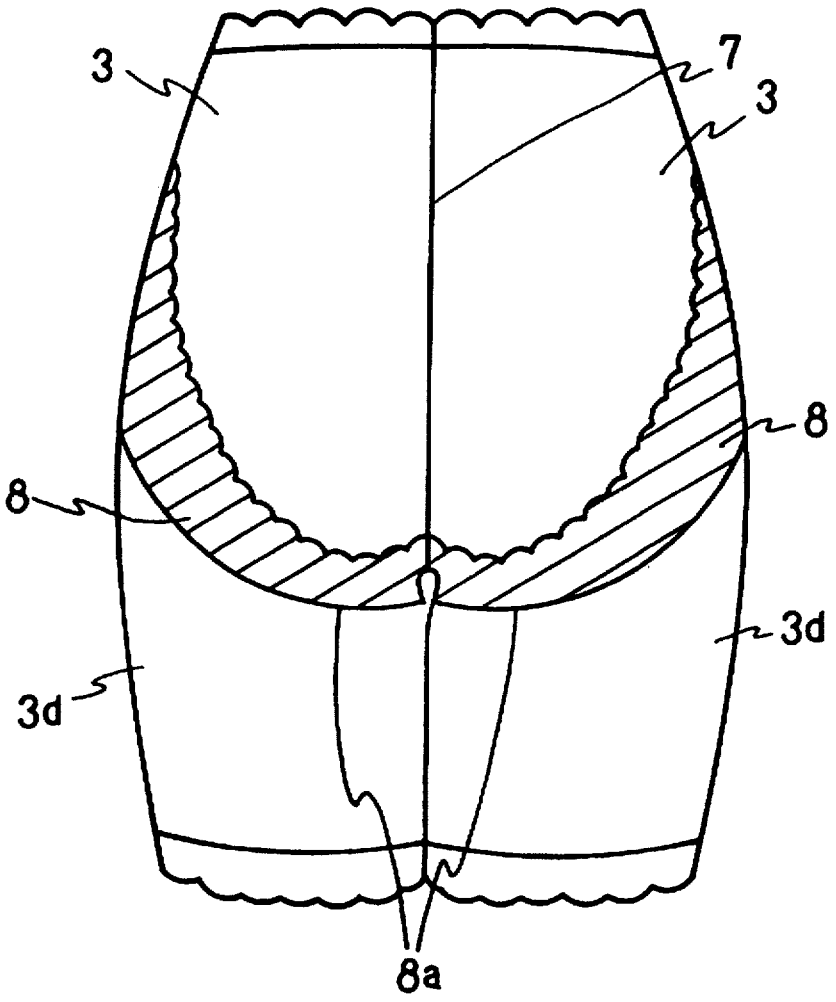
FIG. 9 is a rear view of a long type girdle of one embodiment of the present invention.
Figure 10:
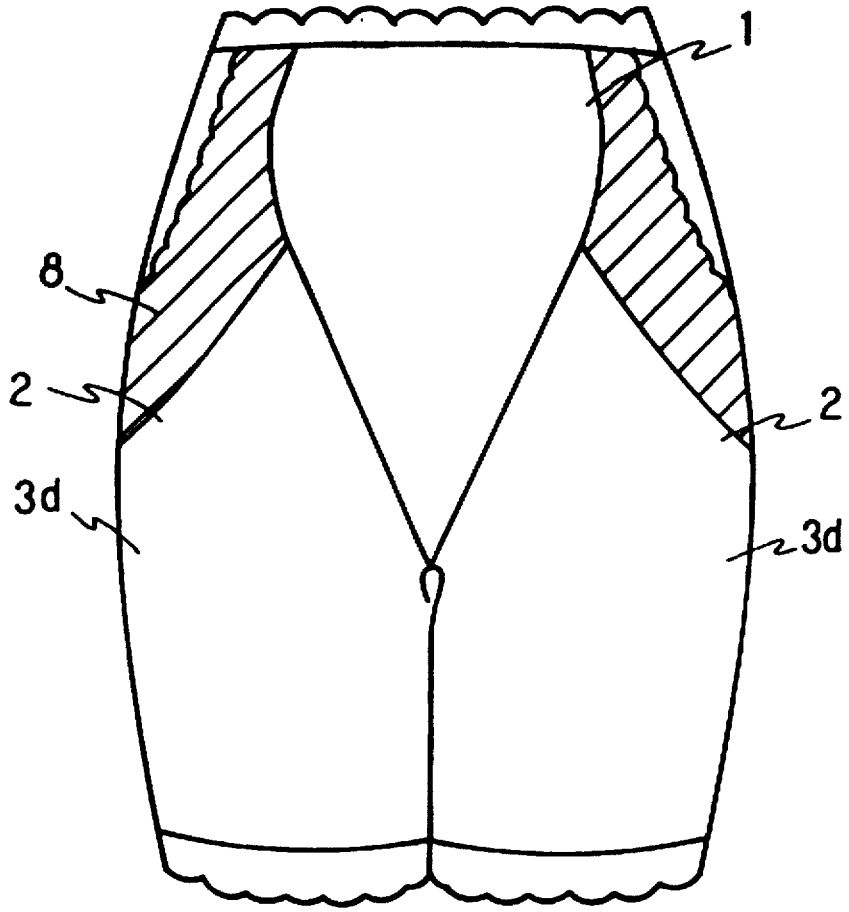
FIG. 10 is a front view of the long-type girdle of FIG. 9.

FIG. 9 is a rear view of a long-type girdle of one embodiment of the present invention. FIG. 10 is a front view of a long type girdle of FIG. 9. This girdle is a long type girdle covering a leg partly. The long-type girdle comprises a fabric of the abdomen part 1, a fabric of the front side 2, and a fabric of the back part covering a buttock 3. The fabric of the front side 2 and the fabric of the back part 3 may be made of separate fabrics, however, this type of the long girdle usually is made of one continuous fabric. The fabric is seamed together at the inner portion of a wearer's thigh (the seam line cannot be seen, so the seam line is not illustrated in FIGS. 9 and 10) to form the leg part 3*d*. Numeral 7 denotes a seam line in the back center. 3*d* shows the part covering the leg part of the front side 2 and the back part of 3. In order to keep superflouous flesh from swelling outward, for the fabric of the abdomen part 1 a fabric that does not stretch or hardly stretches in at least the lateral direction of the girdle is used, or a patch that does not stretch or hardly stretches is attached to either the reverse side or the front side of the girdle.

In the girdles shown in FIGS. 9–10, the band-shaped patch 8 which stretches in at least the longitudinal direction attached to the inside of the back part 3 in the portion from the vicinity of the back center of the lower part of a buttock extendly obliquely upward in the side direction of the garment. In this case, as is apparent from FIG. 10, the patch 8 extends to the fabric of the front side 2 and extends to the front of the girdle to reach to the edge of the abdomen part 1.

In this type of the girdle, as in FIGS. 1 and 2, the patch stretches easily when being put on. Also the patch supplements and supports the function of keeping an upward profile for the hip and buttock lines of the fabric of the back part 3 containing the polyurethane fiber, provides a girdle excellent in following the movements of the human body because of the patch's moderate power of stretching, does not easily lose shape, and is comfortable to wear without making a wearer feel restricted. Moreover, the patch is free from being twisted or moving out of the desired position when put on. In addition, the structure of attaching the patch to the fabric of a main body of the garment shown in any of FIGS. 3–5, can provide the girdle having the function of keeping an upward profile for the hip and buttock line which can maintain the excellent appearance without wrinkles on the main body of the garment due to the increased distortion between the patch and main body of the garment when worn.

In particular, in the case of the long-type girdle, by employing the structure of attaching the patch to the fabric of the main body of the garment illustrated in FIG. 5 and not seaming the lower edge of the patch 8 (lower portion of the patch 8*a*) to the back part 3, the patch becomes free. When compared to the case where the entire circumference of the patch is fixed by seaming with the main body of the garment, this structure of attaching the patch to the main body of the garment can preferably inhibit the increase in the distortion due to the difference in stretch between the patch and main body of the garment and can maintain the excellent appearance by preventing wrinkles on the main body of the garment when worn.

Figure 11:
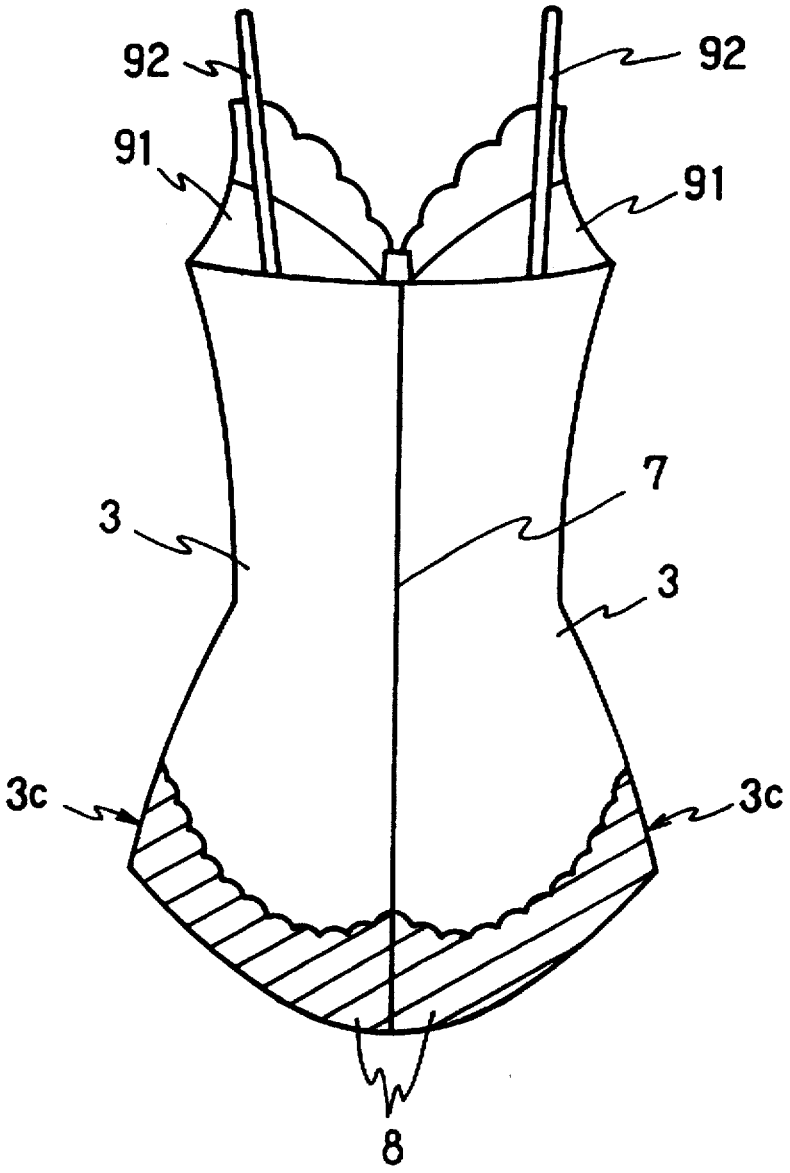
FIG. 11 is a rear view of a body suit of one embodiment of the present invention.
Figure 12:
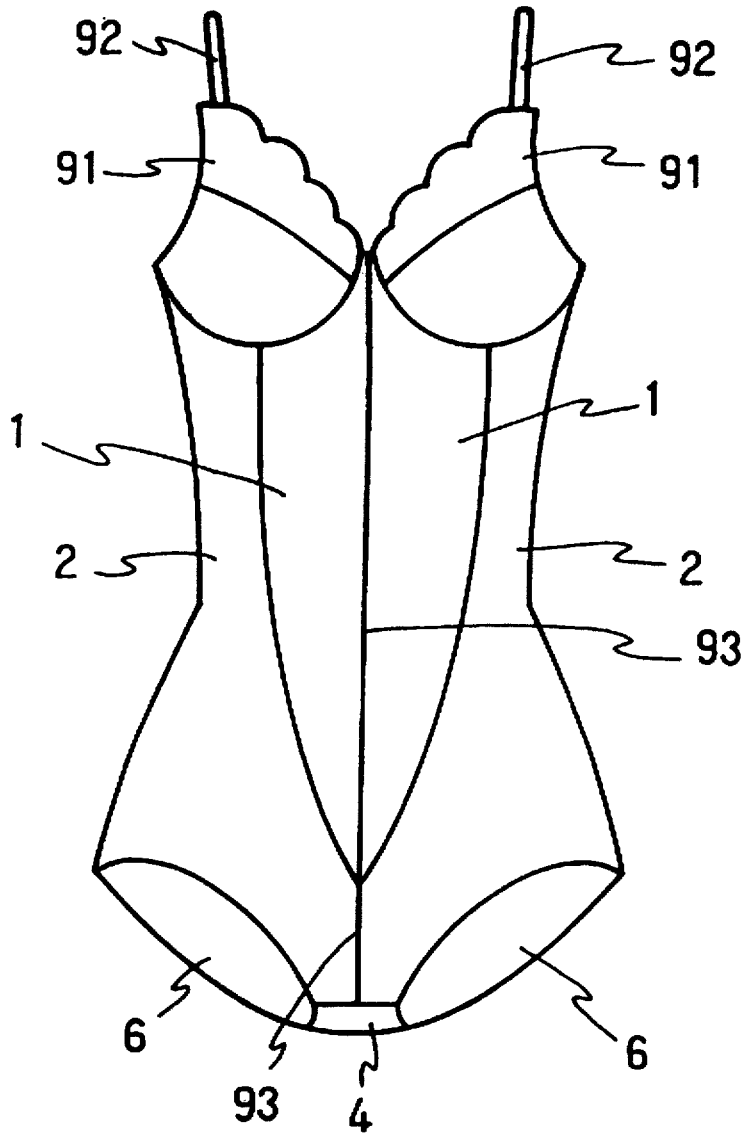
FIG. 12 is a front view of a body suit of FIG. 11.
Figure 13:
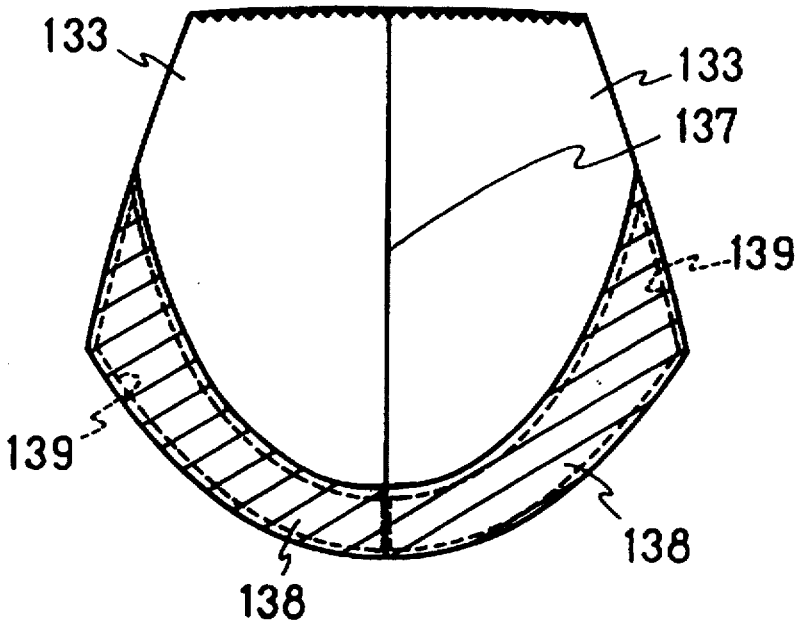
Prior Art Fig. 13
FIG. 13 is a rear view of a conventional girdle.
Figure 14:
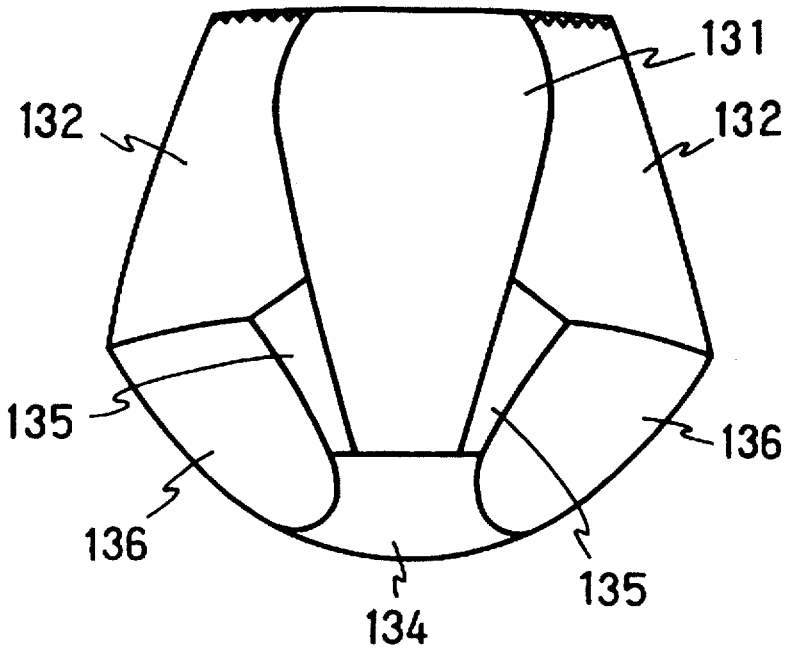
Prior Art Fig. 14
FIG. 14 is a front view of the girdle of FIG. 13.

FIG. 11 is a rear view of a body suit of one embodiment of the present invention. FIG. 12 is a front view of a body suit of FIG. 11. In this body suit, the fabric of the abdomen part 1 is seamed together by a seam line 93 in the front center. Numeral 2 is a fabric of the front side, 3 is a fabric of the back part covering at least a buttock region, 91 is a portion of the cup of the breast, 92 is a shoulder strap, and 7 is a seam line of the back center. In order to keep superflous flesh from swelling outward, for the fabric of the abdomen part 1, a fabric that does not stretch or hardly stretches in at least the lateral direction of the body suit is used or the patch that does not stretch or hardly stretches is attached to either the reverse side or the front side of the body suit. For fabrics of the other main parts, for example, a fabric of the front side 2 and fabric of the the back part 3, fabric which contains an elastic fiber such as polyurethane fiber and which stretches in at least the lateral direction or in both the lateral and longitudinal direction of the body suit is used.

In the body suits shown in FIG. 11 and 12, the band-shaped patch 8 which stretches in at least the longitudinal direction is attached to the inside of the back part 3 in the portion from the vicinity of back center of the lower part of a buttock extendly obliquely upward in the side direction of the garment.

In this type of the body suit, as with the girdle shown in FIG. 7, the patch stretches easily when being put on. Also the patch supplements and supports the function of keeping an upward profile for the hip and buttock lines of the fabric of the back part 3 containing the polyurethane fiber, provides a body suit which is excellent in following the movements of the human body because of the patch's moderate power of stretch, does not easily lose shape, and is comfortable to wear without making a wearer feel restricted. Moreover, the patch is free from being twisted or moving out of the desired position when put on. In addition, the structure of attaching the patch to the fabric of a main body of the garment shown in any of FIGS. 3–5, can provide the body suit having the function of keeping an upward profile for the hip and buttock line which can maintain the excellent appearance without wrinkles on the main body of the garment due to the increased distortion between the patch and main body of the garment when worn.

In the above mentioned specific embodiments, the case where the patch is attached to the reverse side of the main body of the garment is described. But if necessary, the patch optionally can be attached to the front side of a garment.

(1) As stated above, in the garment of the present invention, the part of the main body covering at least a buttock is made of a stretchable fabric that contains an elastic fiber, and the stretchable patch is made of the stretchable fabric that substantially does not contain an elastic fiber. Consequently, the patch can supplement and support the function of keeping an upward profile for the hip and buttock line by the fabric of the main body of the garment containing an elastic fiber. However, the patch substantially does not contain an elastic fiber, so that the power of retraction is not too strong. Therefore, the present invention can provide a garment which is excellent in following the movement of the human body, does not easily lose its shape because of the moderate power of stretch is comfortable to wear without making a wearer feel restricted, and is easy to wear because it can easily be stretched when put on.

(2) In the preferred embodiment of the garment having the function of keeping an upward profile for the hip and buttock line of the present invention, the both sides and upper edge of the patch are seamed with the main body of the garment, but the lower edge of the patch is not seamed with the main body of the garment or is seamed with only the folded portion where a hem edge of a fabric of the main body of the garment is folded back. In the preferred embodiment of the garment of the present invention, the lower edge of the patch becomes quite free. When compared with the case where the entire circumference of the patch is fixed by seaming with the main body of the garment, the garment having the function of keeping an upward profile for the hip and buttock line of the present invention can maintain an excellent appearance when worn by inhibiting wrinkles due to the difference in the stretchability between the patch and main body of the garment. Moreover, also in this embodiment, the patch is seamed with the main body of the garment in at least the both sides and upper edge, so that the garment having the function of keeping an upward profile for the hip and buttock line can be provided. The garment is easy to wear because the patch is not easily twisted or does not get out of the desired position when worn unlike the above mentioned case where only the both sides are seamed with the garment main body without seaming the upper and lower edges of the patch with the main body of the garment.

(3) In the preferred embodiment of the garment having the function of keeping an upward profile for the hip and buttock line, the patch being stretchable in at least the longitudinal direction has the marginal stretchability in the longitudinal direction in the range of 120–250%. According to this preferred embodiment of the garment of the present invention, the garment can easily be put on because the garment can be easily stretched. Since the moderate power of the stretch is exhibited when worn, the present invention can provide the garment which is comfortable to wear without making a wearer feel restricted, is excellent in following the movement of the human body, and does not easily lose its shape.

(4) In the garment having the function of keeping an upward profile for the hip and buttock line, the patch being stretchable in at least the longitudinal direction has the marginal stretchability in the longitudinal direction in the range of 150–220%. According to this preferred embodiment of the present invention, the garment can easily be put on and taken off because the garment can easily be stretched. Since the moderate power of the stretch is exhibited when worn, the present invention can provide the garment which is comfortable to wear without making a wearer feel restricted, is excellent in following the movement of human body, and does not easily lose its shape.

(5) In the preferred embodiment of the garment having the function of keeping an upward profile for the hip and buttock line, the patch being stretchable in at least the longitudinal direction is 2–13 cm in width. According to the preferred embodiment of the garment of the present invention, the discomfort in wearing due to the large width of the patch can be inhibited and the necessary function of keeping an upward profile for the hip and the buttock line can be exhibited.

(6) In the preferred embodiment of the garment having the function of keeping an upward profile for the hip and buttock line, the patch being stretchable in at least the longitudinal direction is made of a knitted fabric that substantially does not contain an elastic fiber and which is selected from the group consisting of tricot, tulle net, double tricot and smooth. These fabrics have the excellent touch and can be fitted to the human body. Consequently, even if the patch made of these fabrics is attached inside the garment, the garment does not make a wearer feel uncomfortable. Moreover, these fabrics are available easily and excellent in durability, so that the garment having the function of keeping an upward profile for the hip and buttock line which is excellent in durability can be provided with low cost.

(7) In the garment of the present invention having the function of keeping an upward profile for the hip and buttock line, the fabric of the main body covering a buttock region contains an elastic fiber and is stretchable in at least the lateral direction of the garment. According to the above mentioned preferred embodiment of the present invention, the garment can be put on and taken off easily because the garment can be stretched in the lateral direction when put on and taken off and can be fitted to the human body when worn.

(8) In the garment of the present invention having the function of keeping an upward profile for the hip and buttock line, the fabric which contains an elastic fiber and is stretchable in at least the lateral direction is selected from the group consisting of rochelle knitted fabric containing an elastic fiber, tricot knitted fabric containing an elastic fiber, and stretch lace containing an elastic fiber. The above mentioned preferred embodiment of the present invention can be made of these appropriate stretchable fabrics which can easily be obtained and which have the excellent touch and can be fitted to the human body. These fabrics are available easily and excellent in durability, so that they can provide the garment having the function of keeping an upward profile for the hip and buttock line, which is excellent in durability, with low cost.

(9) In the garment of the present invention having the function of keeping an upward profile for the hip and buttock line, the garment having a crotch part is a garment selected from the group consisting of short panty, girdle, body suit, swim suit, leotard and tights. These garments are worn by fitting to the human body or worn in direct contact with the human body or worn near to the human body. Consequently, the above mentioned function of keeping an upward profile for the hip and buttock line can be exhibited. Moreover, since these garments are worn in direct contact with or near to the human body, in other words, these garments are worn in the location on which the stretching power is easily exerted, they are preferably comfortable to wear without making a wearer feel restricted. These above mentioned specific garments are suitable as the garment of the present invention in effectively performing the above mentioned functions.

(10) In the garment of the present invention having the function of keeping an upward profile for the hip and buttock line, the garment having a crotch part is a long-type girdle whose band-shaped stretchable patch having the stretchability is a two-folded fabric where a fabric of the patch is folded into two. The patch is located in a way so that the folded portion is downward on the main body of the garment and the both sides and upper edge of the patch are seamed with the main body of the garment, but the lower edge of the patch is not seamed with the main body of the garment. According to the above mentioned preferable embodiment of the present invention, the patch becomes freer because the lower edge thereof is not seamed with the main body. When compared to the case where the entire circumference of the patch is fixed by seaming with the main body, this structure of attaching the patch to the main body can preferably inhibit the increase in the distortion due to the difference in the stretchability between the patch and main body of the garment and can maintain the excellent appearance by preventing wrinkles on the main body of the garment when worn.

Finally, it is understood that the invention may be embodied in other specific forms without departing from the spirit or essential characteristics thereof. The embodiments disclosed in this application are to be considered in all respects as illustrative and not restrictive, so that the scope of the invention is indicated by the appended claims rather than by the foregoing description, and all changes which come within the meaning and range of equivalency of the claims are intended to be embraced therein.

What is claimed is:

1. A garment for keeping an upward profile for the hip and buttock line, comprising:

a main body defining a crotch part and having a first portion that in use covers at least a user's buttock region, the first portion of the main body comprising a stretchable fabric containing an elastic fiber, and a band-shaped patch having sides and upper and lower edges, stretchable in at least the longitudinal direction, attached to the first portion of the main body at a position that in use corresponds to the vicinity of the back center of the lower part of the buttocks, extending obliquely upward in a side direction of the main body, the stretchable patch being made of a stretchable fabric that substantially does not contain an elastic fibers, wherein the sides and upper edge of said patch are seamed with the main body and the lower edge of said patch is not seamed with the main body.

2. The garment according to claim 1, wherein the patch has a marginal stretchability in the longitudinal direction in the range of 120–250%.

3. The garment according to claim 2, wherein the marginal stretchability is in the range of 150–220%.

4. The garment according to claim 1, wherein the patch has a width of 2–13 cm.

5. The garment according to claim 1, wherein the patch is formed from a knitted fabric that substantially does not contain an elastic fiber and is selected from the group consisting of tricot, tulle net, double tricot, and smooth fabrics.

6. The garment according to claim 1, wherein the fabric of the first portion of the main body contains an elastic fiber and is stretchable at least in the lateral direction of the garment.

7. The garment according to claim 6, wherein the fabric of the first portion of the main body is selected from the group consisting of rochelle knitted fabric containing an elastic fiber, tricot knitted fabric containing an elastic fiber, and stretch lace containing an elastic fiber.

8. The garment according to claim 1, which is in the form of a garment selected from the group consisting of a short panty, girdle, body suit, swimsuit, leotard, and tights.

9. The garment according to claim 1, wherein the garment is in the form of a long-type girdle, and the patch is a two-plied structure formed by folding a fabric into two, with the patch being disposed so that the folded portion is oriented downward on the main body, the folded lower edge of the patch not being seamed to the main body.

10. A garment for keeping an upward profile for the hip and buttock line, comprising:

a main body defining a crotch part and having a first portion that in use covers at least a user's buttock region, the first portion of the main body comprising a stretchable fabric containing an elastic fiber; and a band-shaped patch having sides and upper and lower edges, stretchable in at least the longitudinal direction, attached to the first portion of the main body at a position that in use corresponds to the vicinity of the back center of the lower part of the buttocks, extending obliquely upward in a side direction of the main body, the stretchable patch being made of a stretchable fabric that substantially does not contain an elastic fiber wherein the sides and upper edge of said patch are seamed with the main body and the lower edge of said patch is seamed only with a free end of a folded portion when a hem edge of the fabric of the main body is folded back.

11. The garment according to claim 10, wherein the patch has a marginal stretchability in the longitudinal direction in the range of 120–250%.

12. The garment according to claim 11, wherein the marginal stretchability is in the range of 150–220%.

13. The garment according to claim 10, wherein the patch has a width of 2–13 cm.

14. The garment according to claim 10, wherein the patch is formed from a knitted fabric that substantially does not contain an elastic fiber and is selected from the group consisting of tricot, tulle net, double tricot, and smooth fabrics.

15. The garment according to claim 10, wherein the fabric of the first portion of the main body contains an elastic fiber and is stretchable at least in the lateral direction of the garment.

16. The garment according to claim 15, wherein the fabric of the first portion of the main body is selected from the group consisting of rochelle knitted fabric containing an elastic fiber, tricot knitted fabric containing an elastic fiber, and stretch lace containing an elastic fiber.

17. The garment according to claim 10, which is in the form of a garment selected from the group consisting of a short panty, girdle, body suit, swimsuit, leotard, and tights.

* * * * *